US009897099B1

(12) United States Patent
Highnote

(10) Patent No.: US 9,897,099 B1
(45) Date of Patent: Feb. 20, 2018

(54) IMPELLER FOR LIQUID SEALED PUMP

(71) Applicant: Sidney T. Highnote, Tetonia, ID (US)

(72) Inventor: Sidney T. Highnote, Tetonia, ID (US)

( * ) Notice: Subject to any disclaimer, the term of this patent is extended or adjusted under 35 U.S.C. 154(b) by 0 days.

(21) Appl. No.: 15/232,496

(22) Filed: Aug. 9, 2016

Related U.S. Application Data

(62) Division of application No. 14/018,854, filed on Sep. 5, 2013, now Pat. No. 9,435,344.

(60) Provisional application No. 61/743,883, filed on Sep. 12, 2012.

(51) Int. Cl.

| | |
|---|---|
| ***F04B 25/04*** | (2006.01) |
| ***F04D 29/22*** | (2006.01) |
| ***F04D 29/42*** | (2006.01) |
| ***F04D 29/10*** | (2006.01) |
| ***F04D 29/043*** | (2006.01) |
| ***F04D 29/046*** | (2006.01) |

(52) U.S. Cl.
CPC ..... *F04D 29/22* (2013.01); *F04D 29/043* (2013.01); *F04D 29/046* (2013.01); *F04D 29/108* (2013.01); *F04D 29/426* (2013.01)

(58) Field of Classification Search
CPC ..... F04D 1/006; F04D 13/02; F04D 13/021; F04D 13/08; F04D 29/22; F04D 29/046; F04D 29/043; F04D 29/108; F04B 15/04
See application file for complete search history.

(56) References Cited

U.S. PATENT DOCUMENTS

| | | | | |
|---|---|---|---|---|
| 1,778,787 | A | | 10/1930 | Arutunoff |
| 1,891,201 | A | | 12/1932 | Hoff |
| 2,331,641 | A | | 10/1943 | Walker |
| 2,515,811 | A | * | 7/1950 | Thrush ..... F04D 29/047 277/367 |
| 2,764,943 | A | | 10/1956 | Peters |
| 2,839,006 | A | | 6/1958 | Mayo |
| 2,914,081 | A | | 11/1959 | Bigham |
| 3,179,827 | A | | 4/1965 | Baker |
| 3,220,352 | A | | 11/1965 | Smith et al. |
| 3,286,712 | A | | 11/1966 | Roden |
| 3,737,255 | A | | 6/1973 | Emeny |
| 3,746,473 | A | | 7/1973 | DeLancey et al. |
| 3,782,860 | A | | 1/1974 | DeLancey et al. |
| 3,897,176 | A | | 7/1975 | Emeny |
| 4,065,232 | A | | 12/1977 | Stratienko |
| 4,493,609 | A | | 1/1985 | Morgan |
| 4,875,836 | A | | 10/1989 | Zehnder et al. |
| 5,104,541 | A | * | 4/1992 | Daniel ..... B01D 17/0217 210/512.1 |
| 5,134,328 | A | | 7/1992 | Johnatakis et al. |
| 5,961,285 | A | | 10/1999 | Meneice et al. |
| 6,139,274 | A | | 10/2000 | Heer |
| 6,315,530 | B1 | | 11/2001 | Goodnick et al. |

(Continued)

FOREIGN PATENT DOCUMENTS

DE 102006006253 A1 8/2006

*Primary Examiner* — Dwayne J White
*Assistant Examiner* — Maxime Adjagbe
(74) *Attorney, Agent, or Firm* — Gardner Groff Greenwald & Villanueva, PC

(57) ABSTRACT

A pump for pumping a fluid includes a motor, a drive shaft, an impeller, a pump housing having an inlet and an outlet portion, and an extension tube extending between the motor and the pump housing. Preferably, a portion of the fluid to be pumped is contained within the extension tube at a relatively constant level to provide a seal.

22 Claims, 9 Drawing Sheets

(56) References Cited

U.S. PATENT DOCUMENTS

| | | | | |
|---|---|---|---|---|
| 6,854,957 | B2 | 2/2005 | Shi | |
| 7,165,953 | B2 | 1/2007 | Reynders et al. | |
| 7,811,051 | B2 | 10/2010 | Wagner | |
| 7,828,531 | B2 | 11/2010 | Heng et al. | |
| 9,435,344 | B1 | 9/2016 | Highnote | |
| 2011/0311357 | A1* | 12/2011 | Rodrigues | F04D 29/448 415/204 |

* cited by examiner

IMPELLER FOR LIQUID SEALED PUMP

CROSS-REFERENCE TO RELATED APPLICATIONS

This application is a divisional of U.S. Non-Provisional patent application Ser. No. 14/018,854 filed Sep. 5, 2013, which claims the benefit of U.S. Provisional Patent Application Ser. No. 61/743,883 filed Sep. 12, 2012, the entireties of which are hereby incorporated herein by reference for all purposes.

TECHNICAL FIELD

The present invention relates generally to the field of pumps, and more particularly to liquid sealed pumps and an improved impeller to be used therewith.

BACKGROUND

Pumps generally require shaft packing or mechanical seals to ensure the fluid to be pumped does not harm or cause catastrophic damage to the pump motor, or to ensure the fluid does not leak therefrom. In some cases, a liquid seal can be used instead of shaft packing or mechanical seals, which is much more economical and requires little to no maintenance. U.S. Pat. No. 4,772,183 to Durden, which is incorporated herein by reference, described using a liquid seal that relies on a vacuum in the extension or support tube to keep tube clear of oil or fluid and prevent flooding of motor or motor bearings. It has now been discovered that a potential disadvantage of such a pump is that the vacuum may be lost due to vapor from the liquids forming in the extension tube. In such an event, vapor may open the relief valve at the top of the extension tube allowing flooding of the tube and motor bearings.

Accordingly, it can be seen that needs exist for an improved pump. It is to the provision of a liquid sealed pump with dynamic turbo tech impeller meeting these and other needs that the present invention is primarily directed.

SUMMARY

In example embodiments, the present invention provides a pump for pumping a fluid. The pump preferably includes a motor, a drive shaft, an impeller, a pump housing that includes an inlet portion and an outlet portion, and an extension tube extending between the motor and the pump housing. Preferably, a portion of the fluid to be pumped is contained within the extension tube at a relatively constant level to provide a seal.

In another aspect, the invention relates to a liquid sealed pump preferably including an impeller, a shaft coupled to the impeller for rotationally driving the impeller, a shaft sleeve at least partially surrounding the shaft and allowing rotation of the shaft therein, an extension tube at least partially surrounding the shaft sleeve and defining an annular fluid containment chamber between the extension tube and the shaft sleeve, a sealing fluid supply conduit for delivering a sealing fluid to the annular fluid containment chamber at a first elevation, and a sealing fluid return conduit for discharging the sealing fluid from the annular fluid containment chamber at a second elevation. The shaft sleeve preferably includes at least one relief hole allowing fluid flow therethrough, and a sealing fluid level is maintained in the annular fluid containment chamber between the first elevation and the second elevation.

In another aspect, the invention relates to a pump impeller for a liquid sealed pump. The impeller preferably includes an extended snout defining a bearing surface, and a plurality of semi open face impeller vanes.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
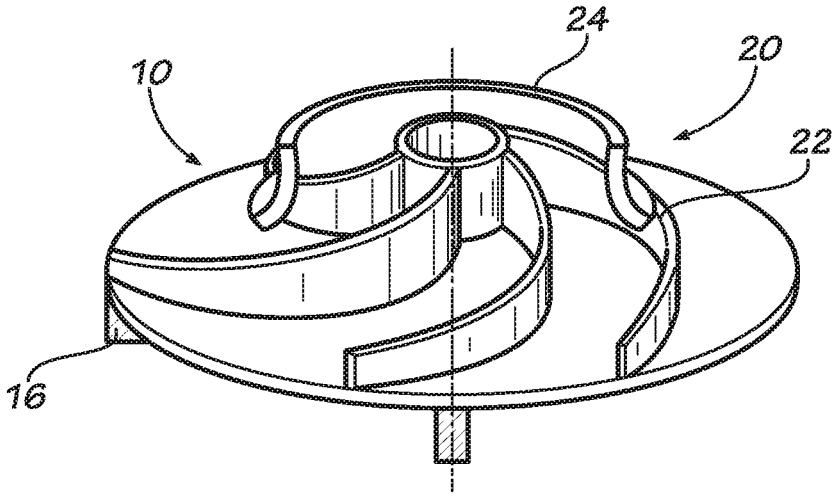
FIG. 1 is a partial cutaway view of an impeller according to an example embodiment of the present invention.
Figure 2:
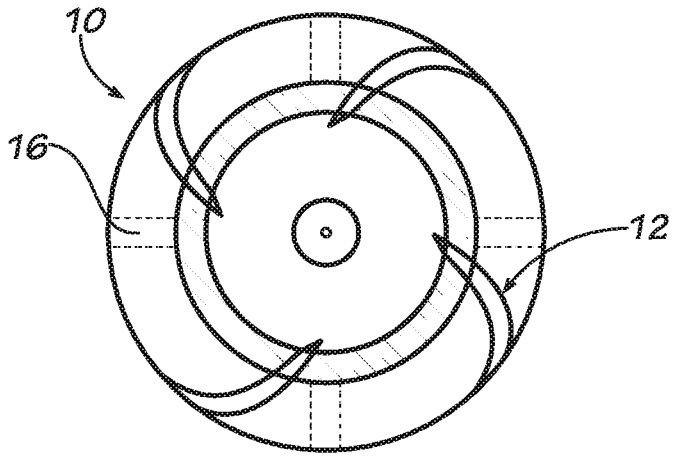
FIG. 2 is a top view of the impeller of FIG. 1.
Figure 3:
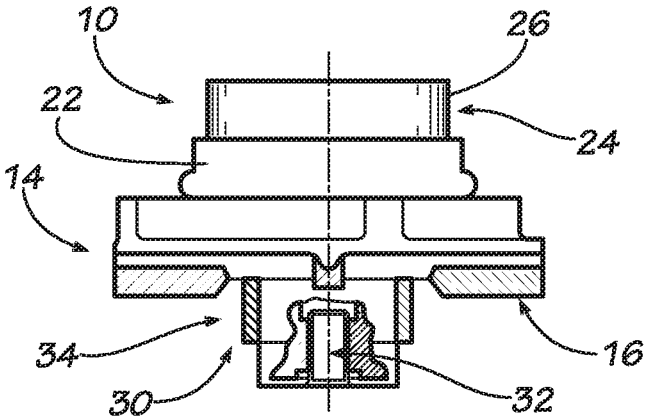
FIG. 3 is a side view of the impeller of FIG. 1.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 show both an impeller 10 and a pump 100 having the impeller 10 rotatably mounted thereto according to an example embodiment of the present invention. In some example forms, the pump 100 is generally constructed similarly to the pump disclosed in U.S. Issued U.S. Pat. No. 4,772,183, the entirety of which is incorporated herein by reference. In one example form, the pump 100 includes a motor M (see FIGS. 6-7 and 9), an extension tube 112 extending from the motor M to a pump housing 116 (comprising an input portion 120, an output portion 122, and a central centrifugal area), a drive shaft 126 extending from the motor M to the impeller 10, a sleeve 130 centrally spaced within the extension tube 112 (and providing an area therein for extension of the drive shaft 126 therethrough), a ring 132 mounted to a top portion of the sleeve 130, a skirt 134 fixedly mounted to an end of the sleeve 130, a runner 136 fixedly mounted to an end of the drive shaft 126, a pump inlet hose 140 for inputting a fluid, an outlet hose 142 for outputting a fluid, and a suction return hose 144. A labyrinth seal is formed by the skirt 134 and the runner 136. Preferably, the pump 100 is configured to be liquid sealed, thus no shaft packing or mechanical seal is required for operation.

Figure 4:
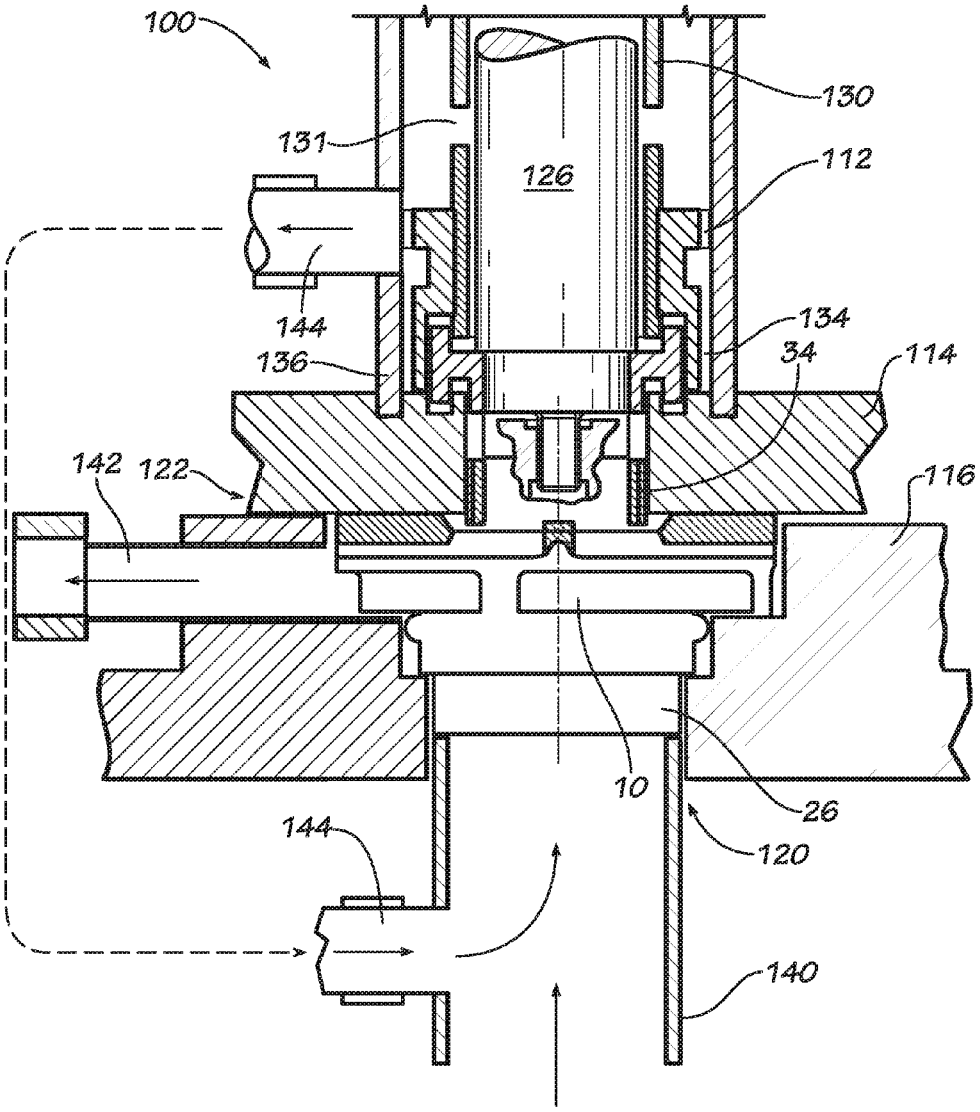
FIG. 4 is a partial side elevation view of a pump assembly according to an example embodiment of the present invention.
Figure 5:
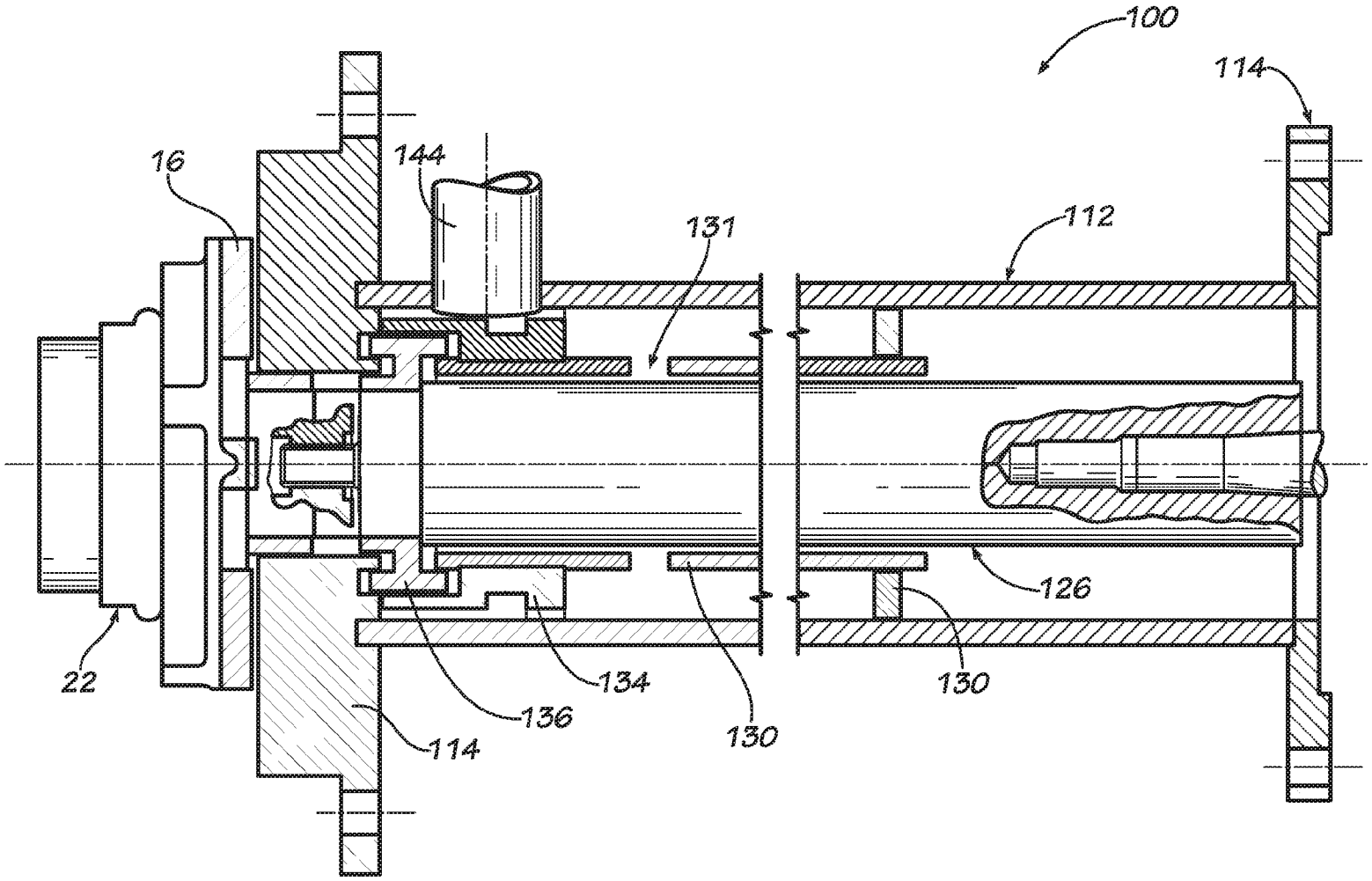
FIG. 5 is a partial side elevation view of the pump assembly of FIG. 4.

The impeller 10 is generally referred to herein as a dynamic turbo tech impeller, which produces a highly efficient flow of fluid or oil compared to standard enclosed or open face impellers. The impeller 10 generally comprises vanes 12, a base 14, a snout portion 20, and a hub 30. Preferably, the impeller 10 comprises a semi-open face that comprises the extended snout 20 working as a bearing surface 26, and a vortex suction generator for pump inlet 120. Two wiper vanes 16 are formed on the base 14. The snout portion 20 generally comprises a base 22 and an extension 24. Preferably, the extension comprises the bearing surface 26. The hub 30 (generally opposite the snout portion 20) generally comprises a centrally-positioned threaded aperture 32 and a bearing surface 34. Preferably, the close tolerances of the bearing surfaces 26, 34 and the impeller vanes 12 provide a highly efficient pump. For example, as depicted in FIGS. 4-5, the impeller 10 is preferably sized so that the bearing surfaces 26, 34 of the snout 20 and hub 30, respectively, maintain a clearance of about 0.002" inches relative to the pump housing 116 and the transverse flange 114. Additionally, in example embodiments the wiper vanes 16 generally maintain a clearance of about 0.005" inches relative to an internal portion of the pump housing 116 (e.g., a surface of the central centrifugal area). In one form, the wiper vanes 16 are advantageous to overall performance of the pump through their ability to assist in keeping contaminants from entering or coming close to the bearing surface 34 of the impeller 10. Further, in example forms, the pump 100 is highly efficient due to ninety percent of impeller vanes 12 being open face and having a clearance of about 0.005" relative to the pump housing 116. Preferably, the curvature of the vanes 12 and diameter of the impeller 10 (in addition to the rotational velocity of the drive shaft 126) determine the capability of the flow rate of the liquid that is to be pumped.

The snout 20 is mounted on the open face vanes 12 by a casting process in producing the impeller 10, or the snout 20 and base 22 can be welded to the impeller vanes 12, or can be formed using alternative manufacturing methods. This snout design with the open face impeller vanes will enhance the pumps ability to minimize leakage from pump housing, therefore allowing the impeller to be more efficient. The semi open face vanes allow particles up to ¼", in small quantities, to pass through the impeller. Particle pass through is important when pumping cooking oil or other fluids contaminated with sediments and particles. Many different bearing materials can be used on the impeller and pump housing to enhance life of the pump. Fluid mediums determine the type bearing materials to be installed on impeller and pump housing.

As will be described below, the pump preferably operates to take advantage of the force of gravity and allow the fluid that is being pumped therethrough to act as the seal. The extension tube 112 serves as a vessel to hold a quantity of the fluid therein, which will maintain the seal. Preferably, a separate fill line is communicatively engaged with a portion of the extension tube 112 to ensure that the extension tube 112 maintains a relatively constant fluid level therein. As such, maintaining a relatively constant fluid level within the extension tube 112 prevents other components of the pump from causing the extension tube 112 from becoming dry, which could cause aeration at the pump inlet.

Figure 6:
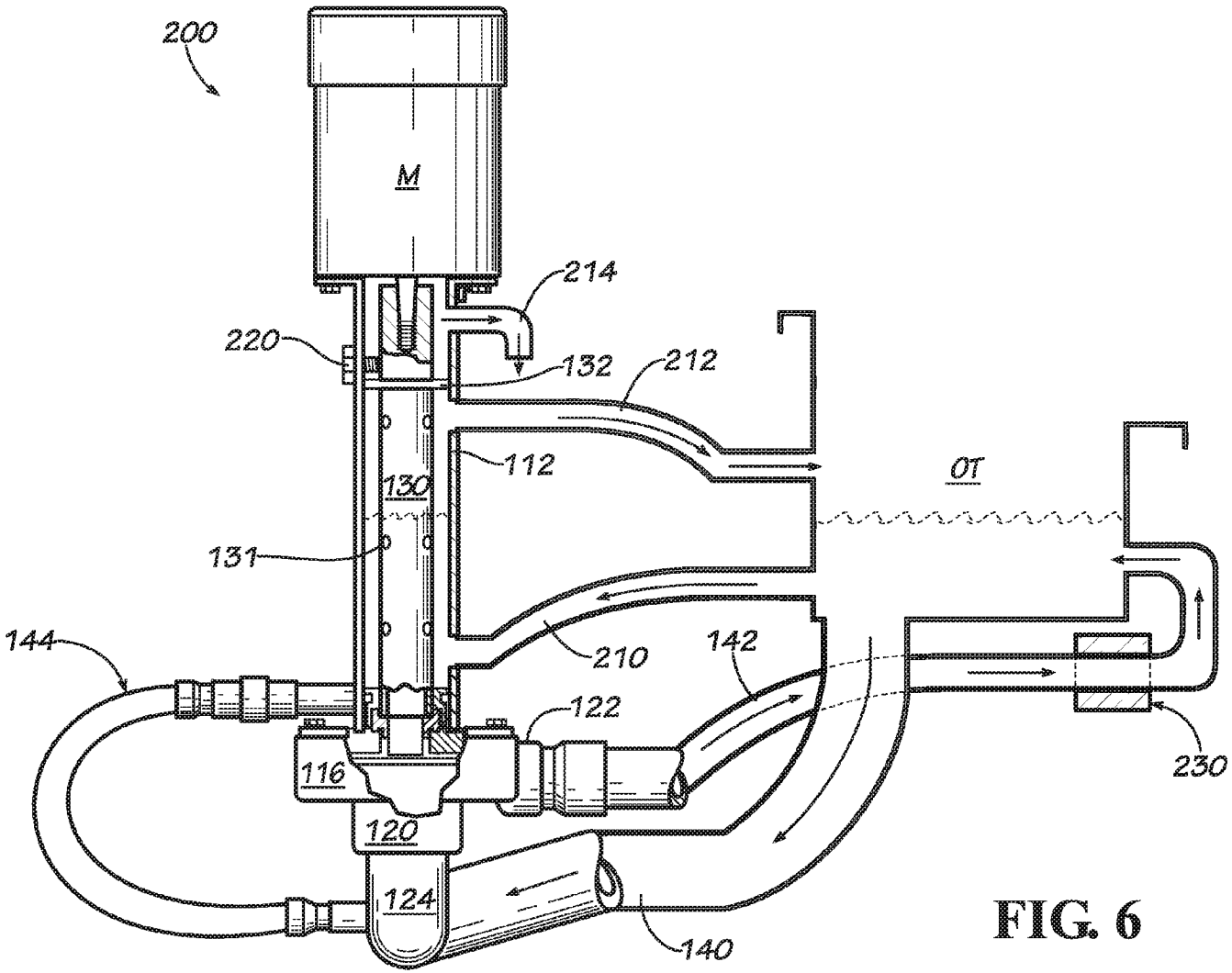
FIG. 6 is a side elevation view of a pump according to another example embodiment of the present invention.

FIG. 6 shows a pump 200 according to an example embodiment of the present invention. As depicted, the pump 200 is connected to an oil tank OT for recirculation of the oil or fluid contained therein, for example, similar to hot oil frying tanks. The pump system comprises an inlet hose 140 extending from the oil tank OT to the inlet portion 120 of the pump housing 116, an outlet hose 142 extending to the outlet portion 122 of the pump housing 116, a sealing fluid supply hose 210 extending to a lower portion of the extension tube 112, an excess or overflow sealing fluid return hose 212 extending to an upper portion of the extension tube 112, and an air vent tube 214 positioned and communicatively engaged proximal the uppermost portion of the extension tube 112. Preferably, the sleeve 130 comprises one or more weep holes 131 extending therethrough to allow fluid to flow therebetween, for example, fluid that may migrate from the labyrinth seal (skirt 134 and runner 136) and up the drive shaft 126, or fluid flowing in the extension tube 112 from the sealing hose 210. In the depicted example, six weep holes 131 are provided, in three pairs at sequentially spaced first, second and third elevations or locations along the sleeve 130. As such, the weep holes 131 ensure that a portion of the shaft sleeve 130 is flooded with oil or sealing fluid. Preferably, the oil or fluid contained within the extension tube 112 (and flooding a portion of the sleeve 130) is maintained at a relatively constant level. And by maintaining a relatively constant level of fluid within the extension tube 112, the fluid preferably also maintains a constant head pressure on the labyrinth seal. Additionally, a bolt 220 can be mounted to a portion of the extension tube 112 (adjacent the ring 132) to hold the sleeve 130 down relative to the runner 136 to ensure steam and vapor pressure do not push the sleeve 120 out of position, which could cause losing the liquid seal. Optionally, a filter and/or heat exchanger can be connected to the outlet hose 142 to transfer heat and/or filter particles from the fluid before returning to the oil tank OT.

Figure 7:
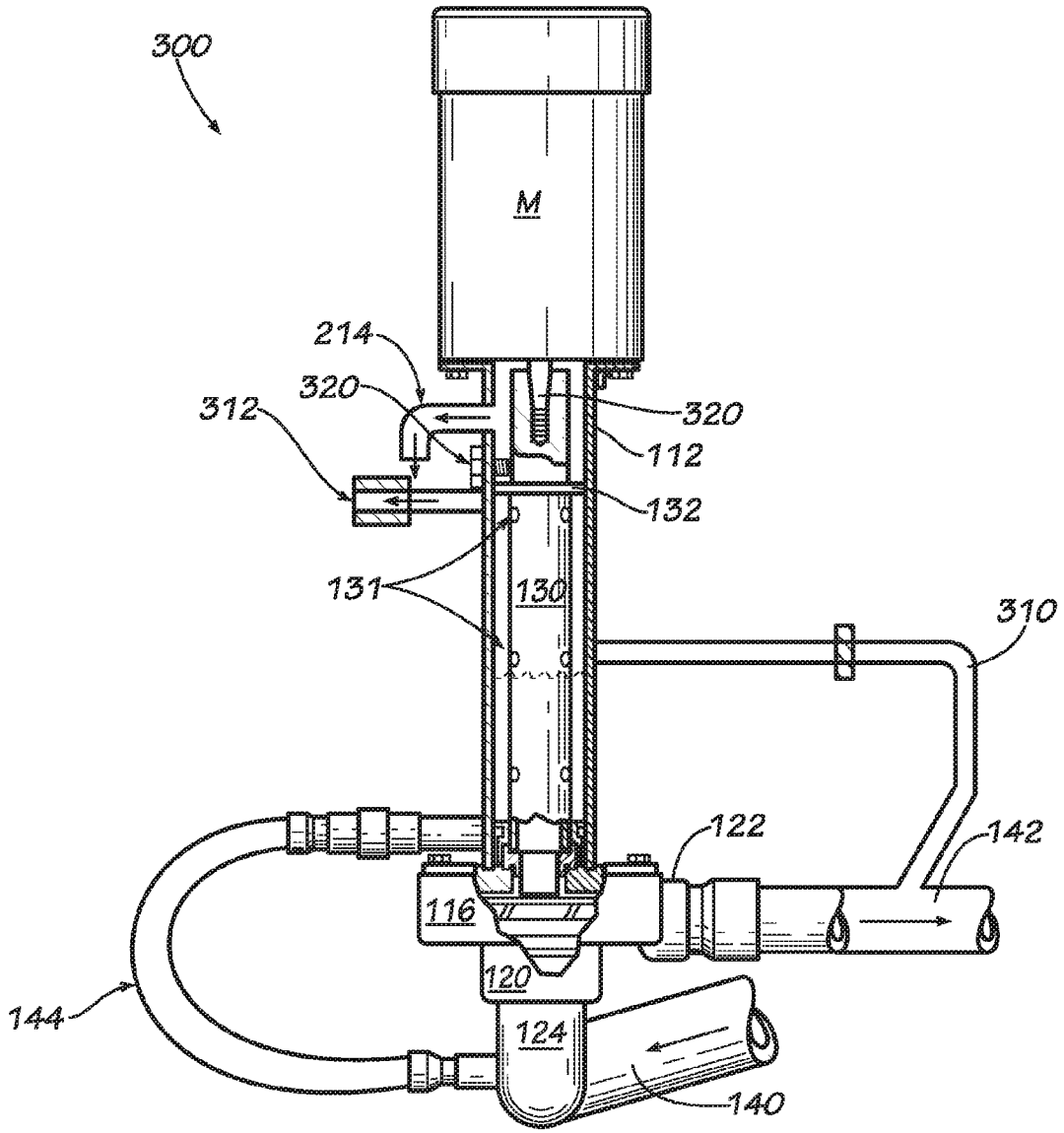
FIG. 7 is a side elevation view of a pump according to yet another example embodiment of the present invention.

FIG. 7 shows a pump 300 according to another example embodiment of the present invention. As depicted, the pump 300 is generally similar to the pump 200. Rather than the pump 300 being connected to an oil tank OT, the pump 300 is configured for a direct line connection. In some forms, a direct line connection is used for irrigation, boost, or sump pumps. A sealing hose 310 preferably extends from the outlet hose 142 to a portion of the extension tube 112 wherein a portion of the fluid being output from the pump can be supplied within the extension tube 112 to ensure a relatively constant fluid level therein. An excess sealing return hose 312 is provided at an upper portion of the extension tube 112 to ensure the fluid level does not rise above the ring 132, and a bolt 320 similarly mounts to the extension tube 112 to hold the sleeve 130 in position. An orifice or valve can be provided in the seal fluid supply line extending from the pump outlet to the seal fluid collection chamber between the pump support tube and the shaft sleeve, to control delivery of oil or other seal fluid through the supply line. One or more hold down bolts can be provided to secure the shaft sleeve to the pump support tube, as shown.

Figure 8:
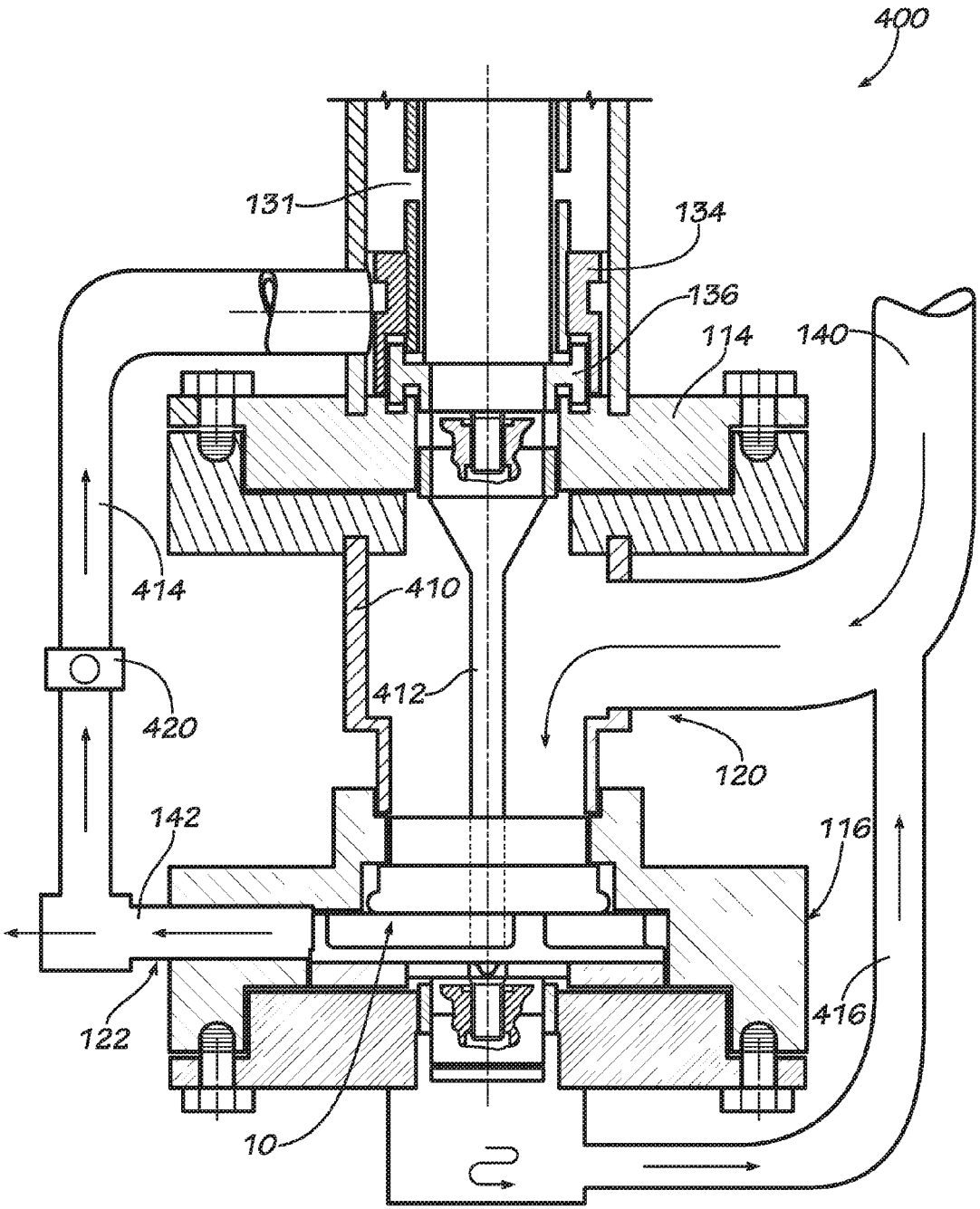
FIG. 8 is a side elevation view of a pump according to another example embodiment of the present invention, wherein the impeller is oriented in an inverted manner.

FIG. 8 shows a pump 400 according to yet another example embodiment of the present invention. Generally, the pump 400 is configured for direct line connection similar to the pump 300. Preferably, the impeller 10 is inverted such that the snout 20 faces the drive shaft rather than facing away from the drive shaft as depicted in FIGS. 4-7. To accommodate the impeller 10 being inverted, a tube extension 410 and a drive shaft extension 412 are provided. Preferably, the impeller 10 comprises a central aperture extending from the snout 20, through the base 14, and to the hub 30 (comprising the threaded aperture 32) such that the drive shaft extension can be mounted thereto. In one example form, the tube extension 410 comprises a 2" inch inlet where the inlet hose 140 mounts. Generally, the tube extension 410 is fixedly mounted between the pump housing 116 and a U-shaped ring 411 (mounted to the transverse flange 114 of the extension tube 112). Preferably, a direct line sealing hose 414 is provided between the outlet hose 142 and the extension tube 112 for supplying fluid within the extension tube 112 to maintain a seal. In one form, a control orifice or valve 420 is connected to the direct line sealing hose 414 to control the flow of the fluid flowing therein. Preferably, the control valve 420 is used to keep fluid or oil level at the proper height in extension tube, thus creating the liquid seal without the use of a tank. Optionally, other means may be used for controlling the flow within the direct line sealing hose 414 to maintain a constant fluid level in the extension tube 112. Additionally, a bearing fluid return hose 416 is provided at the bottom of the pump housing 116 (proximal the hub 30 and bearing surface 34) to capture any fluid flowing past the bearing surface 34. Preferably, the bearing fluid return hose extends from the bottom of the pump housing 116 to the inlet hose 140.

Figure 9:
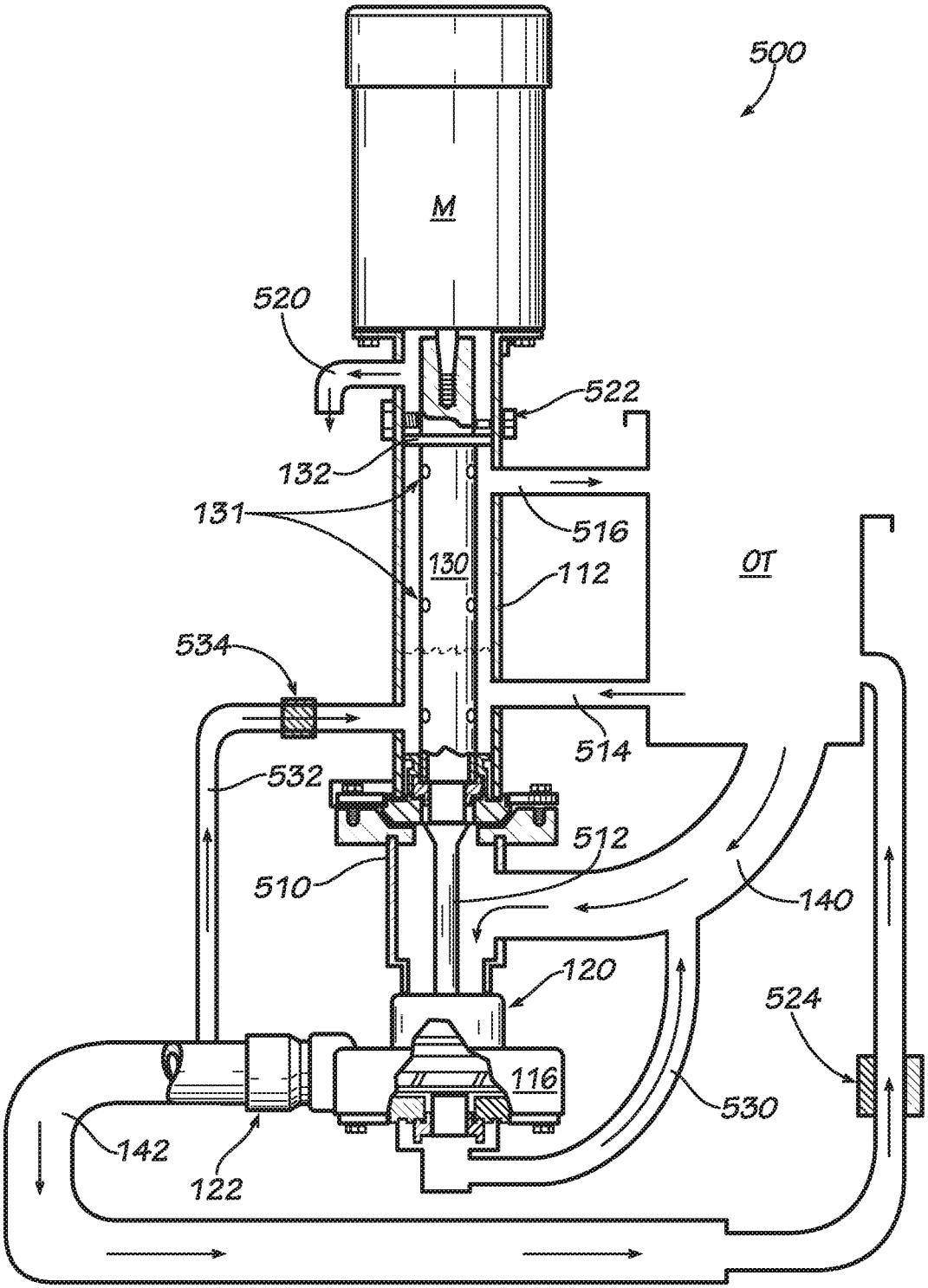
FIG. 9 is a side elevation view of a pump according to another example embodiment of the present invention, wherein the impeller is inverted in an inverted manner.

FIG. 9 shows a pump 500 according to another example embodiment of the present invention. Generally, the pump is configured for connecting to an oil tank OT similar to pump 200, and the impeller 10 is inverted similar to pump 400. As depicted, the oil tank OT comprises an inlet hose 140 extending to the inlet portion of a tube extension 510 (which is connected to the inlet portion 120 of the pump housing 116), an outlet hose 142 extending to the outlet portion 122 of the pump housing 116, a sealing hose 514 extending to a lower portion of the extension tube 112, an excess sealing return hose 516 extending to an upper portion of the extension tube 112, and an air vent tube 520 positioned and communicatively engaged proximal the uppermost portion of the extension tube 112. A bolt 522 is mounted to a portion of the extension tube 112 (adjacent the ring 132) to hold the sleeve 130 down relative to the runner to ensure steam and vapor pressure do not push the sleeve 120 out of position, which could cause losing the liquid seal. Similarly to pump 400, a bearing fluid return hose 530 is provided at the bottom of the pump housing 116 (proximal the hub 30 and bearing surface 34) to capture any fluid flowing past the bearing surface. Preferably, the bearing fluid return hose extends from the bottom of the pump housing 116 to the inlet hose 140. Optionally, a filter and/or heat exchanger 524 can be connected to the outlet hose 142 to transfer heat and/or filter particles from the fluid before returning to the oil tank OT. Optionally, if the pump 500 is not connected to an oil tank OT, a direct line sealing hose 532 is provided between the outlet hose 142 and the extension tube 112 for supplying fluid within the extension tube 112 to maintain a seal. Similarly, a control orifice or valve 534 is connected to the direct line sealing hose 532 to control the flow of the fluid flowing therein.

Figure 10:
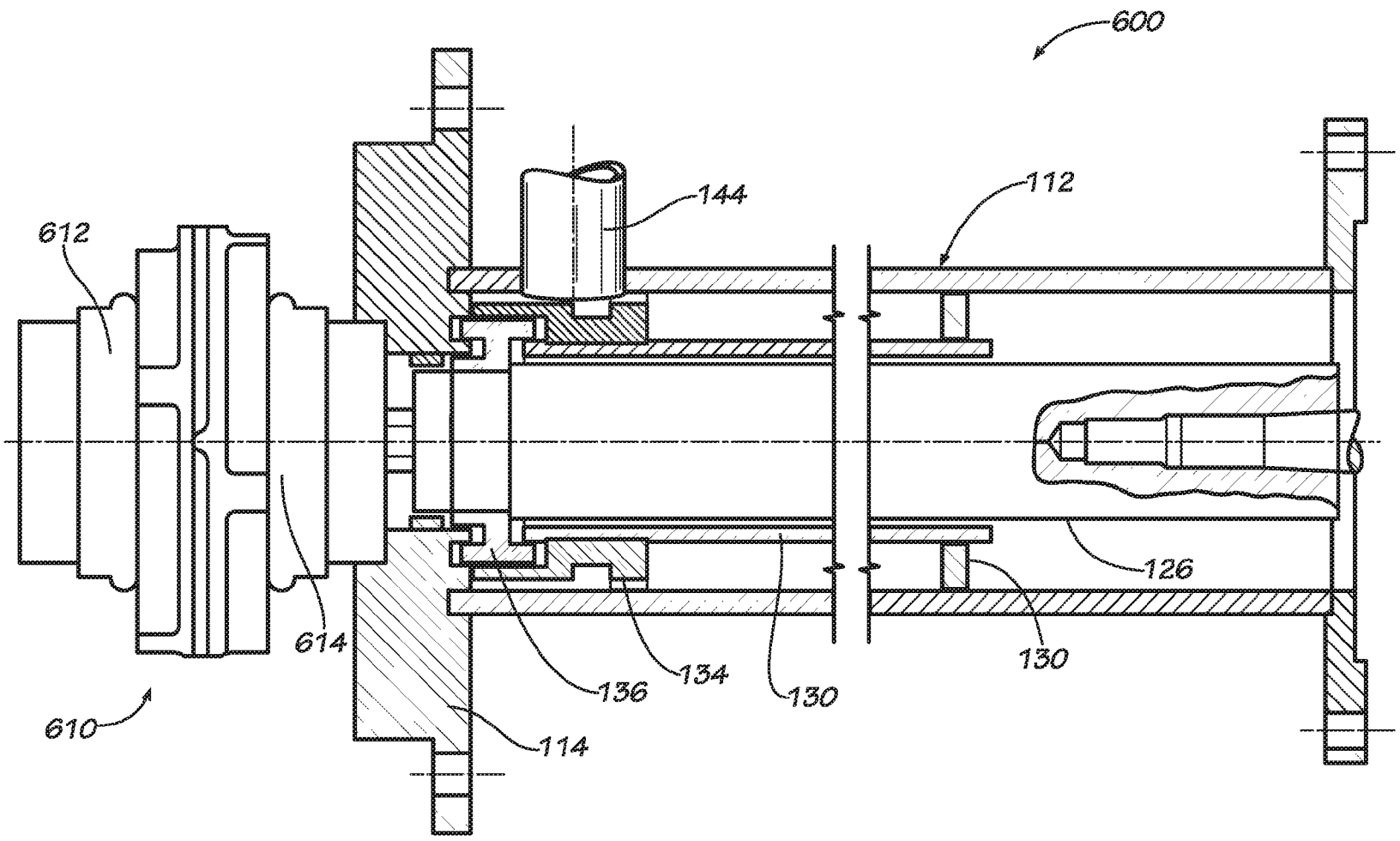
FIG. 10 is a partial side elevation view of a pump according to another example embodiment of the present invention, wherein the pump comprises dual impellers.
Figure 11:
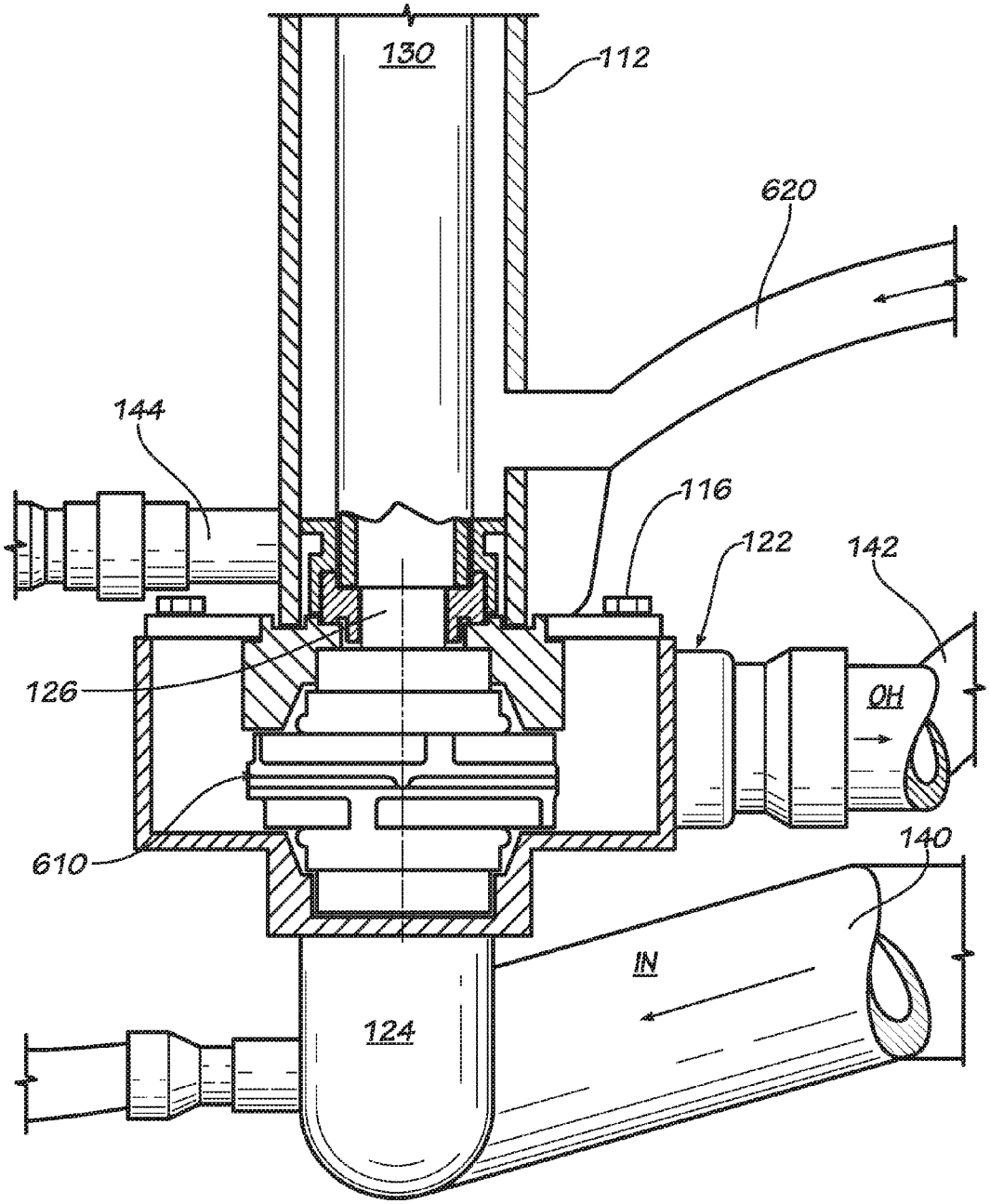
FIG. 11 is a partial side elevation view of the pump of FIG. 10.

FIGS. 10 and 11 show a pump 600 according to another example embodiment of the present invention. In many aspects, the pump 600 is generally similar to the embodiments described above, and can be configured with one or more similar components (e.g., a sealing hose 620, etc.). Pump 600 preferably comprises a dual inlet impeller assembly 610, which provides for maintaining a relatively constant level of liquid within the extension tube 112. The dual impeller 610 preferably comprises first and second impellers 612, 614, which are oriented such that the snouts 20 generally extend in opposite directions from each other. Thus, the bases 14 of each impeller 612, 614 are generally adjacent to one another. In one form, the dual impeller 610 is constructed by a casting process that forms the entire dual impeller 610 as an integral unitary component. Alternatively, one or more fasteners or other connection means can be used as desired to connect two impellers together to form the dual impeller 610. Preferably, the vanes 12 of each impeller are oriented opposite of one another. For example, if the vanes 12 of the first impeller 612 are configured in a clockwise direction, then the vanes 12 of the second impeller 614 are configured in the counter-clockwise direction. This ensures that one impeller is not working against another impeller. Preferably, the dual impeller 610 is designed to pull liquid from the inlet portion 120 of the pump housing 116 as well as the extension tube 112 that is supporting the motor M. And, the purpose for the impeller 610 to pull fluid from the extension tube 112 is to ensure that a portion of the fluid leaving the labyrinth seal is returned back to the pump housing 116 and pumped through the outlet hose 142. Thus, the dual impeller 610, in addition to the sealing hose (and/or other hoses described above), provide a way to maintain the level of fluid within the extension tube 112.

The improvements provided by the pump system of the present invention, including for example one or more of the structural design of the impeller, the drive shaft assembly sleeve, the piping arrangement from oil (or other fluid) source to the extension tube and from the pump inlet and outlet, advantageously produce a liquid sealed vertical pump that requires no shaft packing or mechanical seal for operation, and the pump can be run dry. The liquid or oil being pumped is the seal. The high temperature oil circulating pump U.S. Pat. No. 4,772,183, relied on a vacuum in the extension or support tube to keep tube clear of oil or fluid and prevent flooding of motor or motor bearings. This was not functional after the vacuum was lost due to vapor from the liquids forming in the extension tube. Vapor opened the relief valve at the top of the extension tube allowing flooding of the tube and motor bearings. Holes in the sleeve around the motor shaft let seal fluid weep out of the stationary shaft sleeve to help prevent oil or liquid entering the motor bearings.

The present invention further comprises the following component parts of example embodiments of a pump system:

Item No. 1: Highnote's Dynamic Turbo Tech Impeller produces a highly efficient flow of fluid or oil compared to standard enclosed or open face impellers. See FIGS. 1-3. The close tolerances of the bearing surfaces, and impeller vanes to the pump housing make the pump highly efficient. The first ever Semi open Face Impeller with extended snout working as a bearing service, and a vortex suction generator for pump inlet. The pump is very efficient with, for example, ninety percent of impeller vanes being open face and 0.005" clearance between vanes and pump housing. See FIG. 4. The curvature of the vanes and diameter of the impeller determine the gallons per minute that can be pumped. The wiper vanes, pictured in example form in FIG. 5, provide improved overall performance of the pump through their ability to assist in keeping contaminants from entering the aft bearing of the impeller. The inlet snout is mounted on the open face vanes, for example by a casting process in producing the impeller, or the snout and base can be welded to the impeller vanes. This snout design with the open face impeller vanes will enhance the pump's ability to minimize leakage from pump housing, and therefore the impeller is more efficient. The semi open face vanes allow particles up to ¼", in small quantities, to pass through the impeller. Particle pass-through is important when pumping cooking oil or other fluids contaminated with sediments and particles. Many different bearing materials can be used on the impeller and pump housing to enhance life of the pump. Fluid mediums determine the type bearing materials to be installed on impeller and pump housing.

Item No. 2: The impeller bearing surfaces, and their mounting position in pump housing. Figure shows standard pump head configuration. The second drawing shows a pump head with impeller inverted in relation to the pump flange and extension tube. Snout and Aft bearing surfaces in example forms of both pump designs have 0.002 clearance on each side of pump flange bearing surface. See FIG. 8.

Item No. 3: Hose and piping connection of standard pump configuration, and hose and piping connections for inverted impeller pump to a, fry tank configuration, and direct piping connection to pump inlets. These three drawings demonstrate the operation of the pumps: FIG. 6, FIG. 9, and FIG. 8.

Item No. 4: The labyrinth runner, and drive shaft sleeve. The purpose of these two parts is to minimize the leakage from the pump head, and aeration from drive shaft spinning. Six ¼" relief holes are drilled in shaft sleeve to keep shaft sleeve flooded with oil and to relieve excess oil from labyrinth runner. A bolt is placed in the support tube just above the top of the drive shaft sleeve to hold the sleeve in position from steam and vapor pressure pushing the sleeve out of position causing a loss of the liquid seal. FIG. 5, FIG. 7.

Item No. 5: Suction return hose inlet side of pump allows return of oil or fluid from extension tube to inlet of pump impeller. Drawing No. FIG. 7, and FIG. 6.

Item No. 6: Balancing fluid in extension or support tube, through the return hose, and supply hose from the tank or outlet of pump head. FIG. 9, and FIG. 7.

Item No. 7: The vertical pump can be directly connected to an incoming liquid supply line instead of a tank connection. Tank connections are used for recirculation in most situations, similar to hot oil frying tanks. A direct liquid line connection to inlet of pump, utilizes a hose to be connected from the outlet side of pump head to the extension tube. This type of connection can be used for irrigation, boost, or sump pumps. This piping arrangement allows oil or fluid to flow into the extension tube. An orifice or control valve is used in outlet hose to keep fluid or oil level proper height in extension tube creating the liquid seal without the use of a tank. FIG. 9, FIG. 8 and FIG. 7.

Item No. 8: The liquid sealed components advantageously provide the ability to invert the impeller. FIG. 8 and FIG. 9. The ability to do this allows easy return of liquid or oil from the extension tube directly to the impeller intake. The new oil supply inlet for the pump is on the side of the pump head at the inlet of the impeller. This configuration allows low head operation, along with ease of connection to tank applications. This is a significant improvement over horizontal pumps as far as the ability to adapt to many new pumping situations. Horizontal pumps are known for piping restrictions because of the inlet being horizontal with the pump motor.

The basic operation of the liquid sealed pump is as follows. This pump is vertically designed to take advantage of gravity, and provide a vessel to hold oil or fluid. The extension or motor support tube serves as this vessel. Advantageously, the pump can maintain a constant level of oil or fluid midway in the extension tube, producing a liquid seal. Maintaining oil or fluid in the midway point of the extension tube advantageously keeps the fluid away from the pump motor and the motor bearings. Highnote's Dynamic Turbo Tech Impeller keeps leakage to a minimum from pump head into extension tube. The extended snout and bearing surface create a vortex generator for the pump vanes, improving pumping qualities of the impeller. Another advantage of this impeller is the ability to pass particles through the unit and not clog the vanes.

The dual inlet impeller as shown on the two drawings is designed to pull liquid from the inlet side of the pump as well as the pump column tube supporting the motor. The purpose of the impeller pulling liquid from the pump column is to insure that a portion of the liquid leaving the labyrinth is returned back to the pump head and pumped through the outlet pipe. This provides a means by which a specific level of liquid can be maintained in the pump column providing a liquid seal.

The impeller is preferably cast in one unit. The inlet of the impeller on one side would have left hand rotating vanes while the other would have right hand rotating vanes producing liquid return from the pump inlet and labyrinth pump column. The dual inlet vanes and inlet snout would be the same as the impeller shown in FIGS. 1-3. The purpose again of the dual inlet impeller is to help maintain the liquid level in the pump column or pump support tube shown in FIG. 7.

The pump support tube is a vessel in which a liquid level is maintained by adding or taking liquid away from, by means of the pump impeller and the tank, or external hoses from the pump head. See FIGS. 6 & 9.

While the invention has been described with reference to preferred and example embodiments, it will be understood by those skilled in the art that a variety of modifications, additions and deletions are within the scope of the invention, as defined by the following claims.

What is claimed is:

1. A pump impeller comprising an impeller base, an extended snout spaced from the base defining a first bearing surface and a plurality of semi open impeller vanes extending from a first side of the impeller base toward the extended snout, with the extended snout touching and extending from the impeller vanes and a plurality of wiper vanes and a hub defining a second bearing surface extending from a second side of the impeller base opposite the extended snout.

2. The pump impeller of claim 1, wherein about ninety percent of the semi open face impeller vanes are open face and define a clearance of 0.005" relative to an adjacent pump housing surface.

3. The pump impeller of claim 1, wherein the semi open face impeller vanes are curved.

4. The pump impeller of claim 1, wherein the hub defines a centrally-positioned aperture aligned generally concentrically with the second bearing surface.

5. An impeller for use in a liquid sealed pump having a pump housing, the impeller comprising:

an impeller base;

a plurality of semi open face impeller vanes extending from a first side of the impeller base; and an extended snout mounted on the plurality of semi open face impeller vanes, the extended snout defining a first bearing surface.

6. The impeller of claim 5, wherein ninety percent of the impeller vanes are open face.

7. The impeller of claim 5, wherein a clearance of 0.002 inches is defined between the first bearing surface and the pump housing.

8. The impeller of claim 5, wherein a clearance of 0.005 inches is defined between the impeller vanes and the pump housing.

9. The impeller of claim 5, further comprising a plurality of wiper vanes and a hub defining a second bearing surface extending from a second side of the impeller base opposite the semi open face impeller vanes.

10. The impeller of claim 9, wherein a clearance of 0.002 inches is defined between the second bearing surface and the pump housing.

11. The impeller of claim 9, wherein a clearance of 0.005 inches is maintained between the wiper vanes and the pump housing.

12. The impeller of claim 9, further comprising a central aperture extending from the snout through the base to the hub.

13. The impeller of claim 1, wherein the hub further comprises a centrally-positioned threaded aperture.

14. An impeller for use in a pump housing of a liquid sealed pump, the impeller comprising:

an impeller base;

a plurality of semi open face impeller vanes extending from a first side of the impeller base;

a snout spaced from the impeller base and including a snout base and an extension, wherein the snout base is attached to the plurality of semi open face impeller vanes and the extension defines a first bearing surface; and a plurality of wiper vanes and a hub defining a second bearing surface extending from a second side of the impeller base opposite the first side.

15. The impeller of claim 14, wherein a clearance of 0.002 inches is defined between the first and second bearing surfaces and the pump housing.

16. The impeller of claim 14, wherein a clearance of 0.005 inches is maintained between the wiper vanes and the pump housing.

17. The impeller of claim 14, wherein a clearance of 0.005 inches is defined between the impeller vanes and the pump housing.

18. The impeller of claim 14, further comprising a central aperture extending from the extension of the snout through the base to the hub.

19. A dual inlet impeller assembly comprising:

a first inlet impeller comprising an impeller base, and a plurality of semi open face impeller vanes extending from a first side of the impeller base and an extended snout spaced from the impeller base and extending from the impeller vanes; and a second inlet impeller comprising an impeller base, and a plurality of semi open face impeller vanes extending from a first side of the impeller base and an extended snout spaced from the impeller base and extending from the impeller vanes;

wherein the second side of the base of the first inlet impeller abuts the second side of the base of the second inlet impeller such that the snouts of the first inlet impeller and second inlet impeller are oriented in opposite directions.

20. The dual inlet impeller assembly of claim 19, further comprising a central aperture extending from the snout of the first inlet impeller to the snout of the second inlet impeller.

21. The dual inlet impeller assembly of claim 19, wherein the impeller vanes of the first inlet impeller are curved in a clockwise direction and the impeller vanes of the second inlet impeller are curved in a counter-clockwise direction.

22. In a semi-open pump impeller of the type in which impeller vanes are mounted to or integrally formed with an impeller vane base backing the impeller vanes and in which the impeller vanes are not enclosed by a cover spaced from the impeller vane base, the improvement therein comprising an extended snout comprising:

a base portion in contact with and extending axially away from the impeller vanes; and an extension portion serving as a rotational bearing surface for the impeller.

* * * * *